United States Patent [19]

Mosse et al.

[11] 4,375,145

[45] Mar. 1, 1983

[54] PACKAGING, PARTICULARLY ASEPTIC PACKAGING OF ASEPTIC PRODUCTS IN CARTONS

[75] Inventors: Richard W. E. Mosse, London; Kaare B. Vatne, Ware, both of England

[73] Assignee: Novus Corp. N.V., Curacao, Netherlands Antilles

[21] Appl. No.: 105,541

[22] Filed: Dec. 20, 1979

[51] Int. Cl.[3] ..... B65B 31/02

[52] U.S. Cl. ..... 53/425; 53/467; 53/266 R; 141/103

[58] Field of Search ..... 53/425, 426, 467, 477, 53/267, 266 R, 563, 564; 222/55, 52, 386.5; 141/103, 104; 138/30, 31; 137/486

[56] References Cited

U.S. PATENT DOCUMENTS

| | | | |
|---|---|---|---|
| Re. 15,172 | 8/1921 | Taylor | 141/103 |
| 2,328,372 | 8/1943 | Wollenweber | 141/103 X |
| 2,474,512 | 6/1949 | Bechtold et al. | 138/30 |
| 2,575,863 | 11/1951 | Clifcorn | 53/426 X |
| 2,828,769 | 4/1958 | Cooper | 138/30 |
| 2,841,936 | 7/1958 | Mojonnier | 53/266 |
| 2,870,024 | 1/1959 | Martin | 53/425 X |
| 3,060,654 | 10/1962 | Lubersky et al. | 53/564 X |
| 3,352,458 | 11/1967 | Cramer | 53/267 X |
| 3,566,575 | 3/1971 | Lisiecki | 53/467 X |
| 3,744,209 | 7/1973 | Conley et al. | 53/426 |
| 3,820,300 | 6/1974 | Reinecke et al. | 53/425 |
| 3,911,640 | 10/1975 | Rausing | 53/426 |
| 4,035,981 | 7/1977 | Braun et al. | 53/426 |

FOREIGN PATENT DOCUMENTS

| | | | |
|---|---|---|---|
| 2214080 | 10/1973 | Fed. Rep. of Germany . | |
| 53-25189 | 3/1978 | Japan | 53/426 |
| 54-44988 | 4/1979 | Japan | 53/426 |
| 595248 | 2/1978 | Switzerland | 53/426 |

*Primary Examiner*—Horace M. Culver

*Attorney, Agent, or Firm*—Wegner, McCord, Wood & Dalton

[57] ABSTRACT

An aseptic packaging machine includes a chain conveyor conveying cartons along a path in an aseptic chamber including an advance leg and a return leg each along the machine. Ultra-violet germicidal lamps extend over at least a major portion of the advance leg. Aseptic liquid is fed into the cartons by a filling device comprised of, in turn, an expansion chamber, a non-return inlet valve, a reciprocatory bellows and a non-return valve. After filling, the cartons are top-sealed. The only non-aseptic matter deliberately introduced into the chamber is the cartons. The chamber is cleaned internally by cleaning fluid from spray nozzles. The carton entry to and exit from the chamber have aseptic air curtains.

16 Claims, 10 Drawing Figures

PACKAGING, PARTICULARLY ASEPTIC PACKAGING OF ASEPTIC PRODUCTS IN CARTONS

BACKGROUND OF THE INVENTION

1. Field of the Invention

This invention relates to packaging, particularly aseptic packaging of aseptic products, for example long-life milk, in cartons.

2. Summary of the Invention

According to the first aspect of the present invention, there is provided an aseptic packaging method, comprising introducing containers into an aseptic chamber of an aseptic packaging machine of elongate form; conveying said containers along a path in said chamber including an advance leg and a return leg each extending along the machine; sterilizing the interiors of said containers to render said interiors aseptic, feeding an aseptic product into said containers and sealingly closing said containers, all while said containers are on said path; said sterilizing occurring over at least a major portion of the length of said advance leg.

According to the second aspect of the present invention, there is provided an aseptic packaging machine of elongate form, comprising an aseptic chamber; introducing means arranged to introduce containers into said chamber; conveying means arranged to convey said containers along a path in said chamber including an advance leg and a return leg each extending along the machine; sterilizing means extending over a section of said path forming at least a major portion of the length of said advance leg and arranged to render aseptic the interiors of said containers while said containers are on said section; feeding means arranged to feed an aseptic product into said containers while said containers are on said path downstream of said section; and sealing means arranged sealingly to close said containers while said containers are on said path downstream of said section.

According to the third aspect of the present invention, there is provided packaging apparatus including feeding means arranged to feed a fluid product into containers, said feeding means comprising ducting, a reciprocatory bellows communicating with said ducting for pumping the product, an outlet valve in said ducting arranged to open to allow the product to flow from the bellows during the pressure stroke thereof, and an inlet valve in said ducting arranged to open to allow the product to flow to the bellows during the suction stroke thereof.

According to the fourth aspect of the present invention, there is provided apparatus comprising a dosaging device arranged to deliver a liquid product in predetermined individual doses, a pumping device arranged to deliver continuously said product under pressure, and an expansion chamber by way of which said pumping device communicates with said dosaging device and which has a flexible wall part whereby the volume of said chamber varies in dependence on the difference between the rates of flow of said product thereinto and therefrom.

According to the fifth aspect of the present invention, there is provided an aseptic packaging method, comprising introducing into an aseptic chamber pre-formed, open-topped cartons; sterilizing the interiors of the cartons to render said interiors aseptic while the cartons are in the chamber; feeding an aseptic product into the cartons while the cartons are in the chamber; top-sealing the cartons while the cartons are in the chamber; and removing the aseptic product-containing cartons from the chamber; the only non-aseptic matter deliberately introduced into the chamber being the pre-formed, open-topped cartons.

According to the sixth aspect of the present invention, there is provided aseptic packaging apparatus, comprising an aseptic chamber; introducing and removing means arranged to introduce pre-formed, open-topped cartons into said chamber and to remove aseptic product-containing cartons therefrom; sterilizing means arranged to render aseptic the interiors of the open-topped cartons while the cartons are in the chamber; feeding means arranged to feed an aseptic product into the open-topped cartons while the cartons are in the chamber; and top-sealing means arranged to seal the tops of the cartons while the cartons are in the chamber; the arrangement being such that, in use of the apparatus, the only non-aseptic matter deliberately introduced into the chamber is the pre-formed, open-topped cartons.

According to the seventh aspect of the present invention, there is provided a method of cleaning the internal surface of an aseptic chamber of an aseptic packaging machine, comprising supplying cleaning fluid into said chamber from dispensing means which forms part of said machine and communicates with the interior of said chamber.

According to the eighth aspect of the present invention, there is provided an aseptic packaging machine, comprising an aseptic chamber, and dispensing means communicating with the interior of said chamber and arranged to supply cleaning fluid into said chamber for cleaning the internal surface of said chamber.

According to the ninth aspect of the present invention, there is provided an aseptic packaging machine, including an aseptic chamber having an opening in a wall thereof, and means arranged to produce an aseptic air curtain across said opening.

According to the tenth aspect of the present invention, there is provided an automatic method of filling a container with a liquid product, wherein the container is maintained in a tilted condition in which an internal face thereof is inclined to the vertical and directly below an outlet from which the liquid product flows down onto said internal face.

According to the eleventh aspect of the present invention, there is provided apparatus for automatically filling a container with a liquid product, comprising a downwardly directed outlet for the product, and means arranged to maintain the container in a tilted condition in which an internal face thereof is inclined to the vertical and directly below said outlet.

BRIEF DESCRIPTION OF THE DRAWINGS

In order that the invention may be clearly understood and readily carried into effect, reference will now be made, by way of example, to the accompanying drawings, in which.

DESCRIPTION OF THE PREFERRED EMBODIMENT

Figure 1:
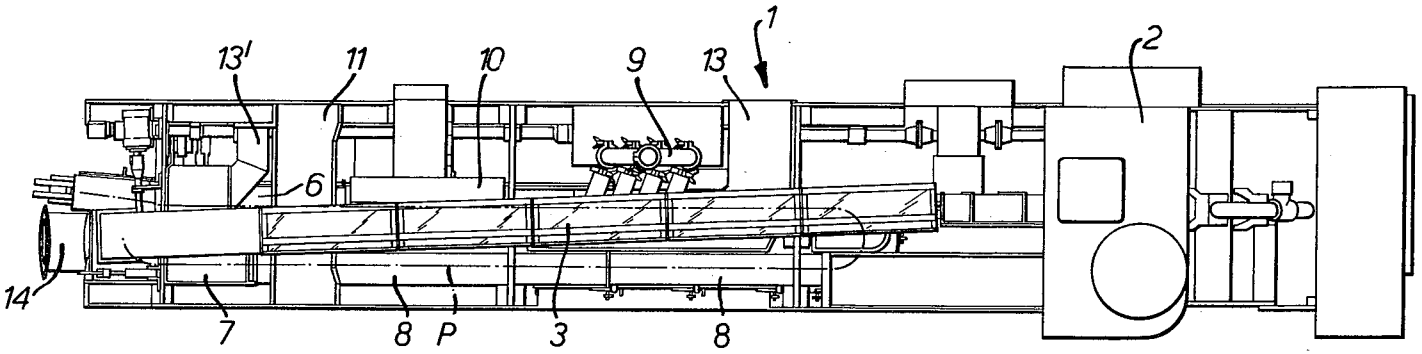
FIG. 1 shows a diagrammatic top plan view of an aseptic packaging machine.
Figure 2:
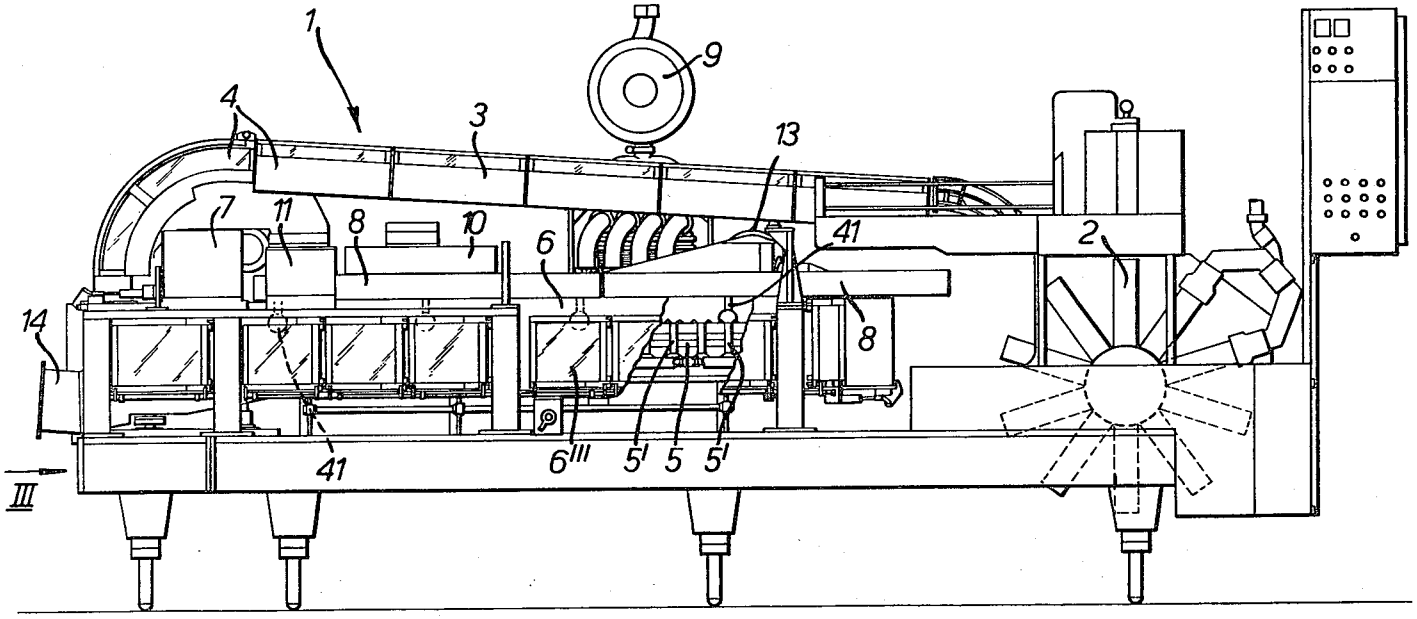
FIG. 2 shows a diagrammatic side elevation of the machine.

Referring to the drawings, the machine 1 for carrying out aseptic packaging includes at one end of the machine a conventional device 2 for pre-forming (including bottom-sealing) gable-topped cartons. The open-topped, pre-formed cartons are taken to the other end of the machine through a closed channel 3 by means of a chain system. The channel 3 is bounded by covers 4 individually liftable about hinges to give access to the channel interior. At this front end of the machine, the open-topped cartons are advanced stepwise and in a vertically upright condition by means of conveying chains 5 along a hairpin-shaped path P of which an advance leg extends along the machine towards the device 2 and a return leg extends along the machine 1 back towards its front end. The cartons exit from the channel 3 directly into an aseptic chamber 6 which totally encloses the chains 5 and which is provided with access covers 6'''. The chains 5, which are arranged coextensively one above another, have projecting therefrom outwardly of the path P long lugs 5' which extend beyond guide strips extending along the path P, the cartons being received among and advanced along the path P by the long lugs 5' and being supported at one side by the chains 5 and at the other side by the guide strips. The chains 5 carry the cartons first of all to a top pre-breaking device 7, where the open top of each carton is pre-broken. Then the cartons are passed beneath high-intensity ultra-violet germicidal lamps 8 which extend over a section of the hairpin-shaped path P which forms at least a major portion, in the present case in fact a major portion, of the length of the advance leg of the path P. In the region of the beginning of this section of the path P, there is arranged some means for introducing into the interior of the carton a fine spray of hydrogen peroxide ($H_2O_2$). This means comprises a nozzle arrangement 7' incorporated in the pre-breaker 7 and serving to spray particularly the inside of the carton with $H_2O_2$. The combined effect on the interiors of the cartons of the ultraviolet radiation and the hydrogen peroxide has a synergistic sterilizing action which is highly germicidal. Where the degree of sterilization required is not very great, it is possible to omit such use of hydrogen peroxide. At the downstream end of this path section, the chains 5 carry the cartons round through 180° to start the return leg of the path P. On this leg, the cartons first arrive at a filling device 9 where the cartons are filled with an aseptic product, for example long-life milk, the cartons then proceeding to a top heating device 10 where thermoplastics surfaces of the top of each carton are heated to a tacky condition, and the cartons are then advanced to a top sealing device 11 where the gable tops are sealed. The cartons leave the aseptic chamber 6 at an exit hole 6'' therefrom at the front end of the machine. Throughout the operation of the machine, aseptic air is fed from a main sterile air filter to aseptic air inlets 13 and 13' of the chamber 6, in which chamber the aseptic air flows from the inlet 13 relatively smoothly to the front end of the chamber 6, where the aseptic air leaves via an aseptic air outlet 14. Not only does the aseptic air act as a scavenging gas removing microbes and hydrogen peroxide from the chamber 6, particularly tending to prevent the microbes and the hydrogen peroxide from being carried up to the filling device 9, but the aseptic air also maintains the interior of the chamber 6 at a pressure slightly above atmospheric and thus discourages the entry of ambient air into the chamber.

Figure 4:
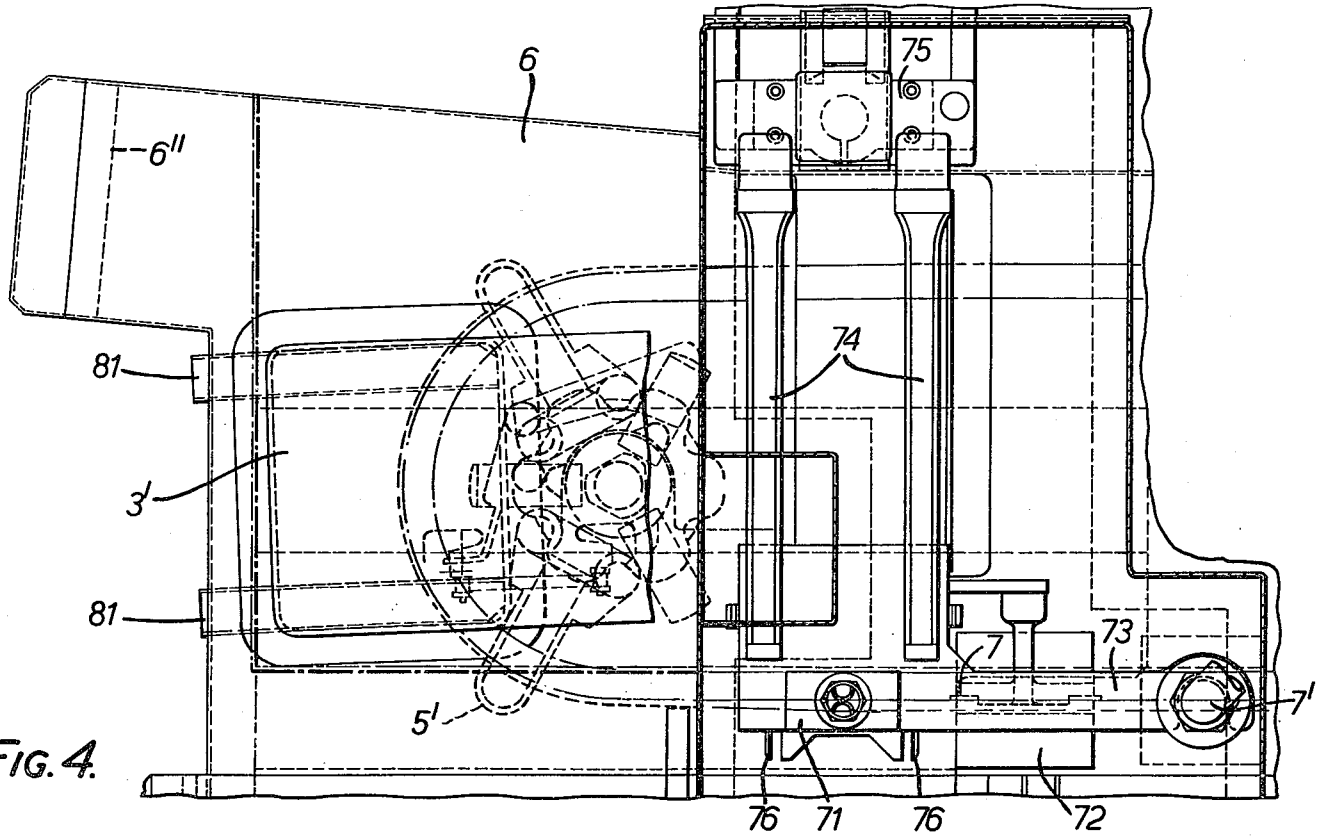
FIG. 4 shows a sectional plan view of the left-hand end of the machine in FIG. 1.
Figure 5:
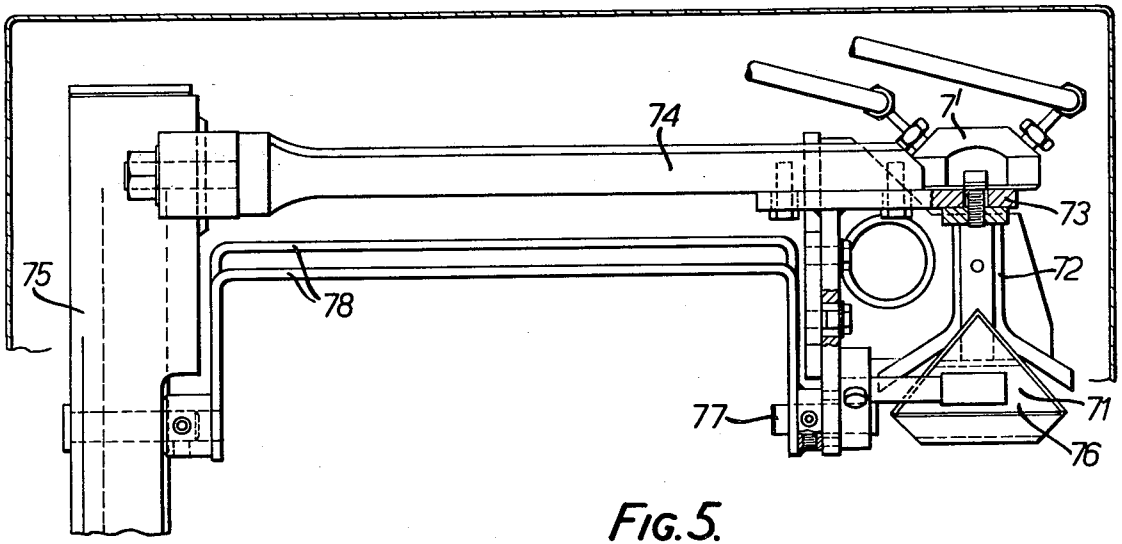
FIG. 5 shows a sectional end elevation of a top pre-breaking device of the machine.
Figure 6:
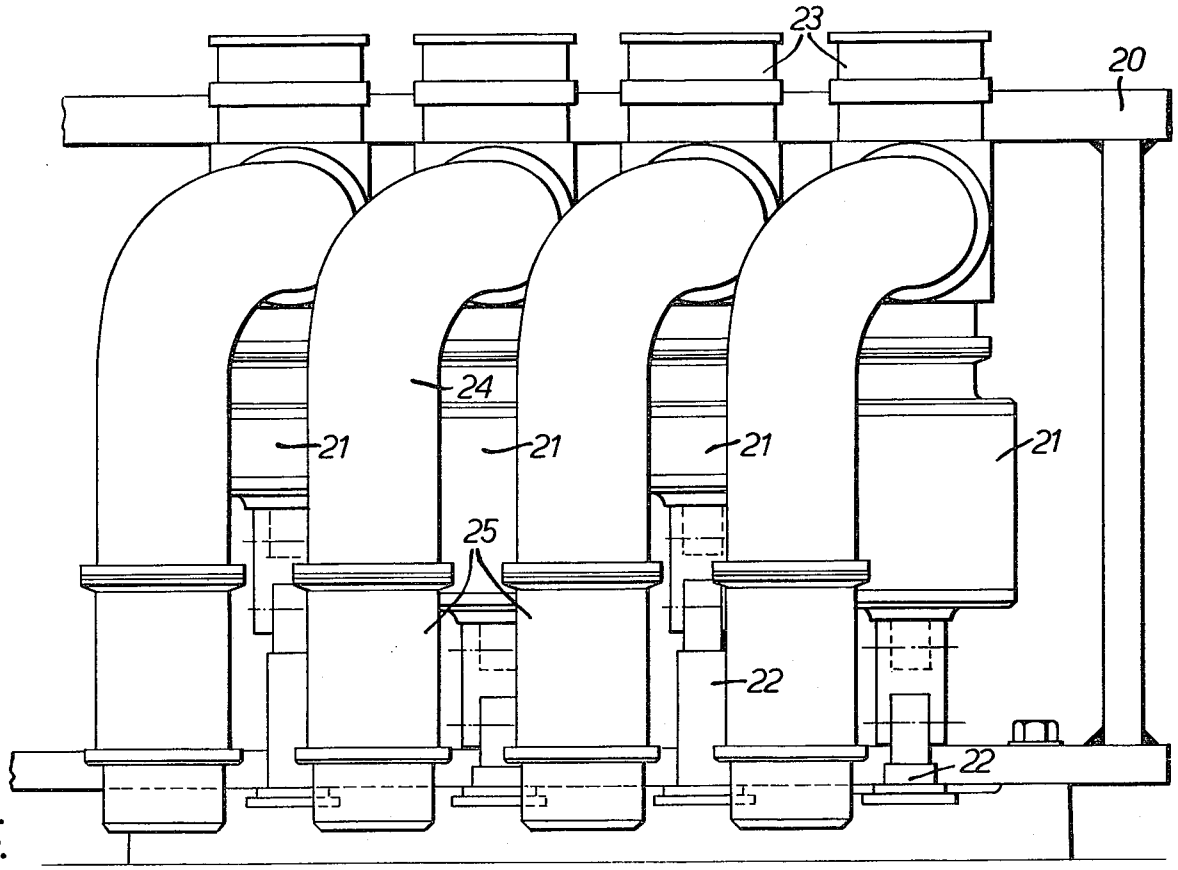
FIG. 6 shows a side elevation of part of a dosaging filling device of the machine.
Figure 7:
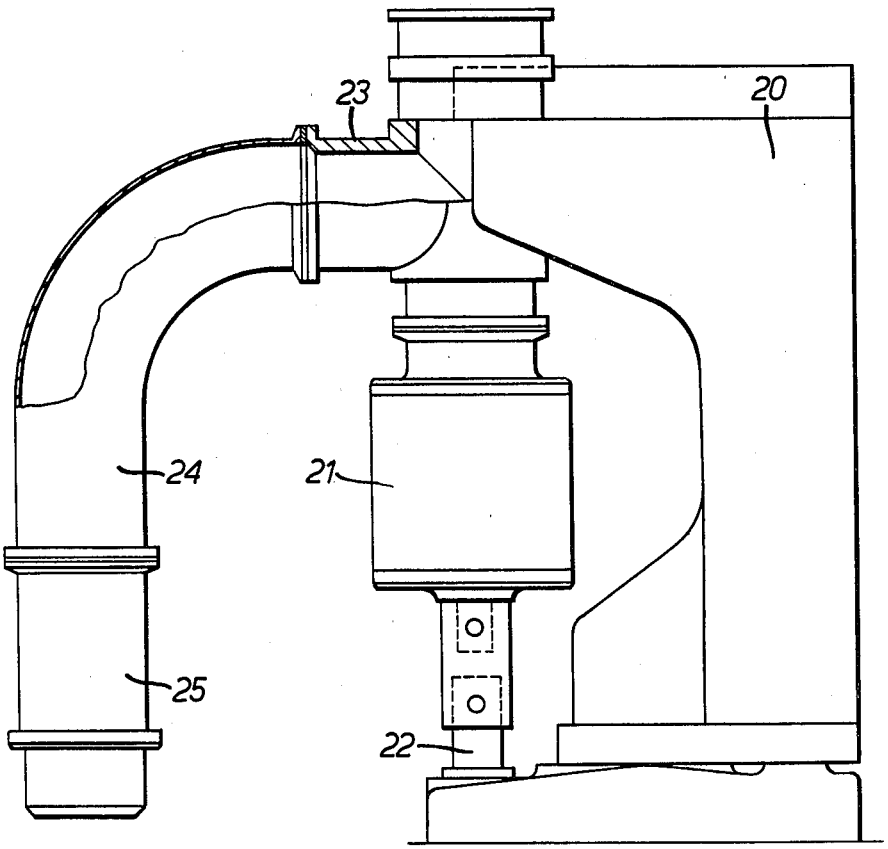
FIG. 7 shows a partly sectional end elevation of that part of the filling device.
Figure 8:
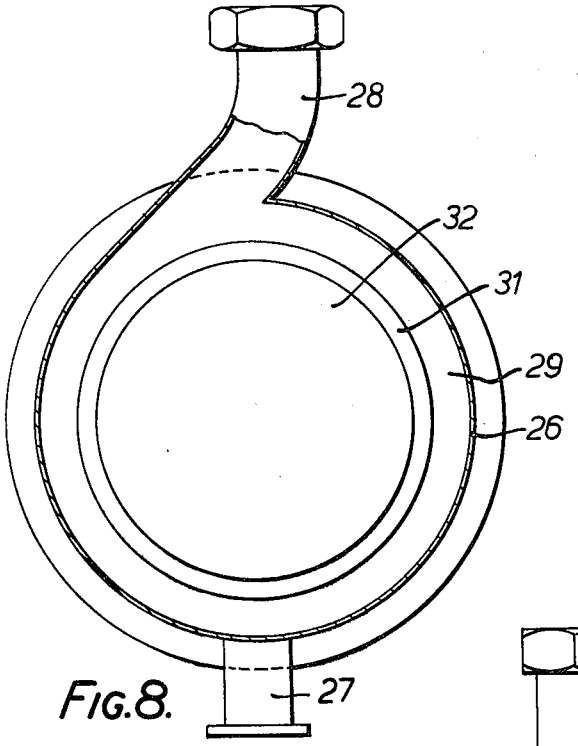
FIG. 8 shows a sectional side elevation of an expansion device of the filling device.

Referring particularly to FIGS. 4 and 5, the top pre-breaker 7 is in two sections 71 and 72 which are carried by a common horizontal support 73 itself carried by two horizontal arms 74 fixed to a vertically reciprocating plunger 75. The section 71 comprises two substantially triangular flaps 76 turnable about respective substantially horizontal parallel pivots 77 by respective oscillatory cranks 78. Between each two advances of the stepwise-advanced cartons, the pre-breaking device 7 is lowered onto the two cartons beneath it, and performs its pre-breaking and simultaneously the $H_2O_2$ is sprayed into the carton immediately beyond the section 72 by the nozzle device 7'.

The filling device 9 is particularly designed to prevent microbes obtaining access to the aseptic liquid product being supplied to the chamber 6. Referring to FIGS. 6 to 9, the filling device includes a mounting frame 20 which mounts four stainless steel reciprocatory bellows 21 having bottom walls which are reciprocatorily driven by respective reciprocatory plungers 22 and having top flanges fixed to respective lower limbs of T-unions 23. Respective upper limbs of the unions 23 contain respective spring-loaded, non-return, inlet valves which open to allow downward flow through the limbs. Intermediate limbs of the respective unions 23 are connected to respective arcuate pipes 24 which curve downwardly and which at their lower ends are connected to respective outlet nozzles 25 which contain respective spring-loaded, non-return, outlet valves. The chains 5 advance the cartons stepwise directly below the line of nozzles 25 and a selected number of the bellows 21 are operated each to deliver a predetermined dosage of long-life milk to the vertically upright cartons, the number of bellows 21 operated being dependent upon the nominal capacity of the cartons. Thus, with each bellows 21 being pre-set to deliver a halfpint at each reciprocation, all four bellows 21 are operated for cartons which can each hold one quart. On each bellows 21 performing a pressure stroke, because the inlet valve in its union 23 is held closed by its spring and by the milk pressure, the outlet valve in the nozzle 25 is automatically opened against the action of its spring to deliver the milk to the carton. On the return stroke of the bellows 21, since the outlet valve is held closed by its spring and by the milk pressure, the inlet valve is automatically opened against the action of its spring so that the bellows 21 can draw in milk from an expansion device 26 shown in FIGS. 8 and 9. The device 26 is connected to the upper limbs of all of the T-unions 23 by way of its outlet 27. A pump (not shown) continuously pumps long-life milk into the device 26 through its inlet 28. The interior of the device 26 is divided into an expansion chamber 29 and a constant-pressure chamber 30 by an annular bellows 31 and a rigid, movable, end closure wall 32 thereof. The chamber 30 is set at a substantially constant pressure owing to the provision of a pressure-regulated air supply to the chamber 30 via a port 33 in a removable end wall 34 of the device 26. There extends through the wall 34 in a fluidtight manner a rod 35 which is fixed at one end to the plate 32. The rod 35 carries abutment flanges 36 which limit the degree of movement of the wall 32 relative to the wall 34. The rod 35 also carries a pointer 37 which moves over a scale 38 to indicate the position of the wall 32 in the device 26. In use of the machine, when the instantaneous rate of delivery of the pump to the inlet 28 exceeds the rate of drawing of the milk into the bellows 21 via the outlet 27, the wall 32 is moved by the pressure of the milk to the right in FIG. 9 against the action of the air pressure in the chamber 30, so that the expansion device 26 acts temporarily as a reservoir until the rate of drawing of the milk into the bellows 21 exceeds the rate of delivery by the pump, in which case the plate 32 moves to the left in FIG. 9 under the action of the air pressure in the chamber 30. It will thus be appreciated that, at least between the pump (not shown) and the outlet valves in the nozzles 25, the filling system is always absolutely full of long-life milk, so that there are no voids or air spaces, which would possibly allow microbes to obtain access to the milk. Another advantage of the present filling system is that all of the internal surface area of the system which in use is in contact with the long-life milk can itself easily be sterilised by simply passing a very hot liquid, chemical cleaning fluid or steam through the filling system, so that all of that internal surface area comes into contact with the very hot liquid, the fluid, or the steam.

Figure 10:
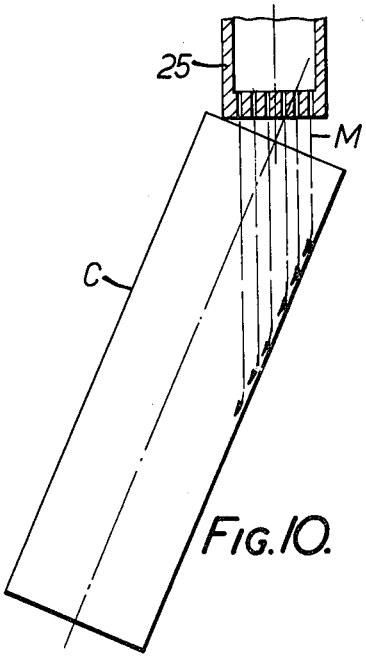
FIG. 10 shows diagrammatically a modified manner of filling a carton by means of the filling device.
Figure 9:
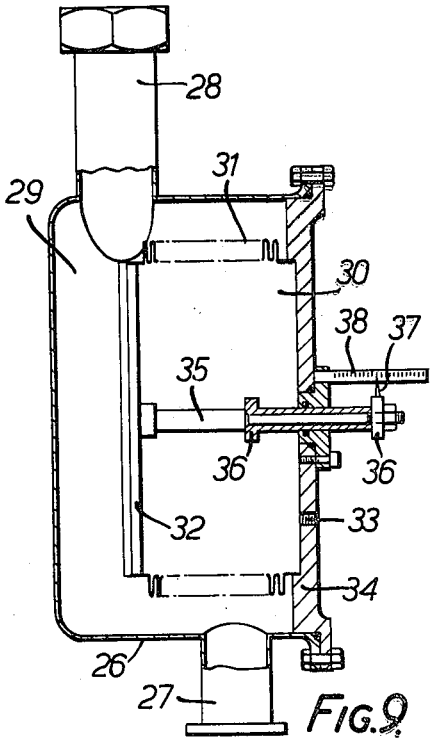
FIG. 9 shows a sectional end elevation of the expansion device.

Referring to FIG. 10, a carton C is shown being filled from one of the nozzles 25. It will be noted that, in this modified manner of filling, the carton C is in a position inclined to the vertical, so that the milk flowing from the nozzle 25 falls down onto an internal face of the carton C which face is inclined to the vertical and is directly below the nozzle 25. Compared to a conventional arrangement in which a nozzle pours milk down into a carton arranged in a substantially exactly upright position directly below the nozzle and thus the milk leaving the nozzle virtually always pours directly onto a body of milk in the carton, the arrangement shown in FIG. 10 has the advantage of minimising the production of foam on the top of the milk. In the present case, the cartons C move along the path P in upright positions, except in the region of the filling device 9, where they are in a tilted condition. It will be appreciated that movement of the carton from its upright condition to its tilted condition and then back to its upright condition can be produced in various ways, particularly by suitable design of the chains 5 and/or the guide strips for the cartons.

The machine 1 also includes automatically controlled means for cleaning the internal surface of the aseptic chamber 6, this means consisting of spray nozzles 41 distributed centrally along the length of the chamber. These nozzles serve to supply a cleaning fluid, e.g. a hot detergent solution or steam, to the interior of the chamber 6 in such a manner that the whole of the interior of the chamber 6 receives the cleaning fluid, which can then be drained off through a drain (not shown).

The machine 1, particularly the aseptic chamber 6 and the associated machine parts, such as the items 5 to 11, are so designed that the only non-aseptic matter deliberately introduced into the chamber 6 is the preformed cartons C.

Figure 3:
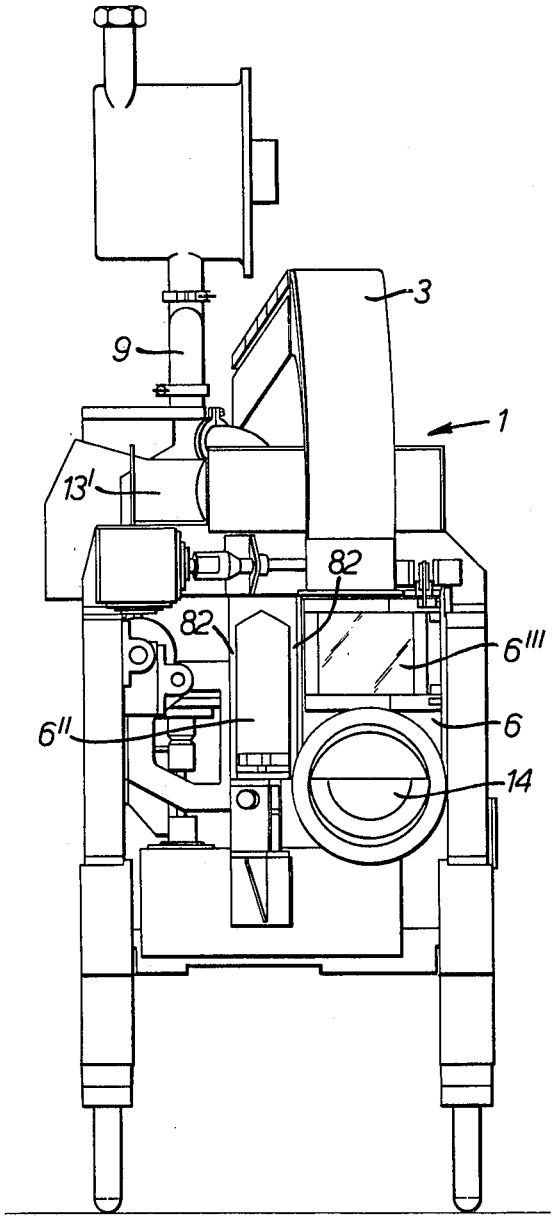
FIG. 3 shows a diagrammatic end elevation of the machine in the direction of the arrow III in FIG. 2.

The entry 3' where the empty cartons enter the aseptic chamber 6 and the exit 6'' where the filled cartons leave the aseptic chamber can be sealed off outside the chamber 6 by respective air curtains of aseptic air at higher pressure. Thus the lower-pressure aseptic air inside the chamber 6 is prevented from escaping. These air curtains are established by slotted tubes 81 and 82 seen in FIGS. 4 and 3, respectively. The aseptic air for the curtains is taken from a separate sterile air filter giving higher pressure than the main sterile air filter for the chamber 6 itself.

We claim:

1. An aseptic packaging method comprising the steps of:

introducing cartons into an aseptic chamber forming part of an aseptic packaging machine of elongate form;

causing said cartons to be received in a closely restrained manner in respective pockets of an endless conveying means totally within said aseptic chamber;

causing said conveying means to displace its pockets and thus said cartons along a path in said chamber including an advance leg and a return leg each extending along the machine; and sterilizing the interiors of said cartons to render said interiors aseptic, feeding a product into said cartons, and sealingly closing said cartons, all while said cartons are on said path, said sterilizing step comprising irradiating said interior with bactericidal radiation over at least a major portion of the length of said advance leg, and said closing step including folding parts of said cartons.

2. A method according to claim 1, wherein said radiation is ultra-violet radiation and said sterilizing includes spraying said interiors with hydrogen peroxide, so that the ultra-violet radiation and the hydrogen peroxide combined have a synergistic sterilizing effect.

3. A method according to claim 2, wherein said spraying is performed in the region of the beginning of said advance leg.

4. A method according to claim 3, wherein said containers are cartons and said spraying is performed at a top pre-breaking station on said path.

5. A method according to claim 1 wherein said feeding step includes feeding liquid product under pressure to an expansion chamber, varying the volume of the expansion chamber in response to the difference between the rate of flow of product into the expansion chamber and the rate of flow of product from the expansion chamber to maintain a substantially constant liquid pressure in the expansion chamber with complete liquid contact on all internal surfaces of the expansion chamber, and intermittently causing liquid to exit the expansion chamber to intermittently discharge liquid product into said cartons.

6. An aseptic packaging method, comprising the steps of:

introducing into an aseptic chamber pre-formed, open-topped cartons;

sterilizing the interiors of the cartons to render said interiors aseptic while the cartons are in the chamber;

feeding a product into the cartons by feeding means while the cartons are in the chamber;

top-sealing the cartons while the cartons are in the chamber;

removing the product-containing cartons from the chamber; and passing a stream of aseptic air through said chamber during said sterilizing, said feeding, and said top-sealing and past said feeding means in the direction from said feeding means towards a carton entry of said chamber.

7. A method according to claim 6, and further comprising forming aseptic air curtain means across carton entry and exit means of said chamber.

8. A method according to claim 6 wherein said feeding step includes feeding liquid product under pressure to an expansion chamber, varying the volume of the expansion chamber in response to the difference between the rate of flow of product into the expansion chamber and the rate of flow of product from the expansion chamber to maintain a substantially constant liquid pressure in the expansion chamber with complete liquid contact on all internal surfaces of the expansion chamber, and intermittently causing liquid to exit the expansion chamber to intermittently discharge liquid product into said cartons.

9. Aseptic packaging apparatus, comprising:

means defining an aseptic chamber having a carton entry and a carton exit;

introducing and removing means arranged to introduce preformed, open-topped cartons into said chamber through said carton entry and to remove product-containing cartons therefrom through said carton exit;

sterilizing means arranged to render aseptic the interiors of the open-topped cartons while the cartons are in the chamber;

feeding means arranged to feed a product into the open-topped cartons while the cartons are in the chamber;

top-sealing means arranged to seal the tops of the cartons while the cartons are in the chamber; and means arranged to pass a stream of aseptic air through said chamber past said feeding means in the direction from said feeding means towards said carton entry of said chamber.

10. Apparatus according to claim 9, and further comprising means arranged to produce aseptic air curtain means across said carton entry and carton exit means of said chamber.

11. A machine according to claim 9 wherein said feeding means comprises means for feeding liquid product under pressure to an expansion chamber, means for varying the volume of the expansion chamber in response to the difference between the rate of flow of product from the expansion chamber and the rate of flow of product from the expansion chamber to maintain a substantially constant liquid pressure in the expansion chamber with complete liquid contact on all internal surfaces of the expansion chamber, and means for intermittently causing liquid to exit the expansion chamber to intermittently discharge liquid product into said cartons.

12. An aseptic packaging machine of elongate form, comprising:

means defining as aseptic chamber;

introducing means arranged to introduce cartons into said chamber;

endless conveying means totally within said chamber and including pockets arranged to receive the respective cartons in a closely restrained manner, said conveying means being arranged to displace its pockets and thus said cartons along a path in said chamber including an advance leg and a return leg each extending along the machine;

sterilizing means comprising bactericidal radiation emitting means extending over a section of said path forming at least a major portion of the length of said advance leg and arranged to render aseptic the interiors of said cartons while said cartons are on said section;

feeding means arranged to feed a product into said cartons while said cartons are on said path downstream of said section; and sealing means arranged sealingly to close said cartons while said cartons are on said path downstream of said section, said sealing means comprising means for folding parts of said cartons.

13. A machine according to claim 12, wherein said bactericidal radiation-emitting means comprises ultraviolet radiation means and said sterilizing means includes spraying nozzle means for spraying said interiors with hydrogen peroxide.

14. A machine according to claim 13, wherein said spraying nozzle means is situated in the region of the beginning of said advance leg.

15. A machine according to claim 14, and further comprising a top pre-breaking means situated in said region for pre-breaking top closures of said containers, said spraying nozzle means being carried by said top pre-breaking means.

16. A machine according to claim 12 wherein said feeding means for feeding liquid product under pressure to an expansion chamber, means for varying the volume of the expansion chamber in response to the difference between the rate of flow of product into the expansion chamber and the rate of flow of product from the expansion chamber to maintain a substantially constant liquid pressure in the expansion chamber with complete liquid contact on all internal surfaces of the expansion chamber, and means for intermittently causing liquid to exit the expansion chamber to intermittently discharge liquid product into said cartons.

* * * * *